US005094308A

United States Patent [19]

De Brock

[11] Patent Number: 5,094,308

[45] Date of Patent: Mar. 10, 1992

[54] METHOD AND DEVICE FOR HEATING PRESSURE BELT OF A PRESS

[75] Inventor: Raoul De Brock, Kortrijk, Fed. Rep. of Germany

[73] Assignee: Firma Theodor Hymmen, Bielefeld, Fed. Rep. of Germany

[21] Appl. No.: 513,312

[22] Filed: Apr. 20, 1990

[30] Foreign Application Priority Data

Apr. 25, 1989 [DE] Fed. Rep. of Germany ..... 3913555

[51] Int. Cl.[5] ..... B30B 15/34; B30B 13/00

[52] U.S. Cl. ..... 100/38; 100/93 P; 100/93 RP; 100/151; 156/583.5; 425/371

[58] Field of Search ..... 100/35, 38, 92, 93 P, 100/93 RP, 151, 153, 154; 425/371; 156/583.5; 165/120

[56] References Cited

U.S. PATENT DOCUMENTS

| | | | |
|---|---|---|---|
| 2,135,763 | 1/1938 | Nicholson | 100/93 P |
| 2,437,680 | 3/1948 | Cornelius | 100/93 RP X |
| 2,459,295 | 1/1949 | Skoog | 100/151 X |
| 2,909,804 | 10/1959 | Means | 100/151 |
| 3,580,795 | 5/1971 | Eichenlaub | 156/583.5 X |
| 3,734,669 | 5/1973 | Ettel | 100/93 RP X |
| 4,311,550 | 1/1982 | Kerttula | 100/93 RP X |
| 4,334,468 | 6/1982 | Güttinger et al. | 100/93 RP |
| 4,794,855 | 1/1989 | Okajima et al. | 100/93 RP X |

FOREIGN PATENT DOCUMENTS

| | | | |
|---|---|---|---|
| 3719976 | 12/1988 | Fed. Rep. of Germany | 100/93 RP |
| 3709958 | 10/1988 | France | 100/93 RP |
| 62-212111 | 9/1987 | Japan | 425/371 |

*Primary Examiner*—Harvey C. Hornsby
*Assistant Examiner*—Stephen F. Gerrity
*Attorney, Agent, or Firm*—Sprung Horn Kramer & Woods

[57] ABSTRACT

A method and device for heating the pressure belt of a press, in which the press pressure is exerted by a gas-filled pressure chamber on the working run of pressure belt and heat transfer is increased by a high circulation rate of the pressure medium in pressure chamber, to create a situation in which a large quantity of heat can be transferred even in the lower pressure ranges. Steam is mixed with a gaseous pressure medium, e.g. air, before it enters the pressure chamber and the back of the pressure belt is exposed to the steam-air mixture in the vicinity of pressure chamber, whereupon the steam condenses wholly or partially on the colder back of the pressure belt in the zone adjacent to the entrance. The heat of condensation thus released results in intensive heating of the pressure belt in this zone and hence of the workpiece.

10 Claims, 3 Drawing Sheets

METHOD AND DEVICE FOR HEATING PRESSURE BELT OF A PRESS

BACKGROUND OF THE INVENTION

The invention relates to a method and a device for heating the pressure belt of a press, wherein the press pressure is exerted on the working run of the pressure belt by a gas-filled pressure chamber, and the heat transfer is increased by a high circulation rate of the pressure medium in the pressure chamber.

A method of this type is known (DE-OS 37 19 976) in which the pressure is generated by a fluid pressure medium in a pressure chamber, said chamber being sealed all the way around and delimited on one side by a pressure plate and on the other side by the pressure belt of a press, especially a double-belt press, said pressure medium being movable by force. The pressure medium is moved in turbulent fashion in the operating zone in a short circuit between the internally heated pressure plate and the back of the pressure belt, at flow rates of 2 to 50 m/sec, preferably 20 to 40 m/sec in the case of gaseous pressure media.

In this known method, the degree of heat transfer capability of the pressure medium can be controlled by varying the flow rate and/or the operating pressure. The heat transfer capability of the pressure medium is increased by a higher flow rate and/or an increased operating pressure.

In the case of materials for whose compression and/or curing a relatively low pressure is created in the pressure chamber, the circulation rate of the pressure medium must be sharply increased accordingly, resulting in increased energy consumption. In addition, the quantity of heat transferable by the known method is not sufficient for certain tasks.

SUMMARY OF THE INVENTION

The goal of the invention is to provide a method of the species recited at the outset and a device for working this method such that the quantity of heat that can be transferred in a pressure chamber (a pressure cushion) of a press, especially a double-belt press, with rapidly moving liquid pressure media, is increased so that a large quantity of heat can be transferred even in the lower pressure ranges.

This goal is achieved according to the invention by the steam being added to the gaseous pressure medium, for example air, before it enters the pressure chamber, and by exposing the back of the pressure belt in the vicinity of the pressure chamber to the steam-air mixture.

In one advantageous embodiment of the method, the steam condenses in the zone of the pressure chamber adjacent to the entrance, or partially on the colder back of the pressure belt.

In this method, when the steam-air mixture enters the pressure chamber, at least a portion of the steam contained in the air settles out as droplets of condensation on the pressure belt, made of strip steel, so that a considerable quantity of heat, namely the condensation heat, is given up to the pressure belt and hence to the product to be processed in the press.

In one embodiment of the method according to the invention, the water droplets precipitated on the back of the pressure belt in the area where the pressure medium enters is evaporated before the pressure medium escapes from the pressure chamber and is absorbed by the pressure medium.

The pressure belt, which is cooled in the inlet area of the pressure chamber by the product which has not yet been heated, said belt advantageously being made of steel, acts as a condenser in the part of the pressure chamber which is close to the inlet for the pressure medium, while the product, heated by the heat of condensation which is released, also gives up heat to the pressure belt, so that the heated pressure belt, before the air flow escapes from the pressure chamber, acts as an evaporator for the drops of water that have precipitated on the back of the pressure belt.

In order to increase the heat transfer from a heated pressure plate delimiting the pressure chamber on one side or from another heating device onto the pressure belt, the air stream used as a pressure medium can be saturated with steam before it enters the pressure chamber.

Additional features of the invention will be apparent from the following wherein embodiments of devices for working the method according to the invention are shown in the drawings and are described below.

DETAILED DESCRIPTION OF THE INVENTION

Figure 1:
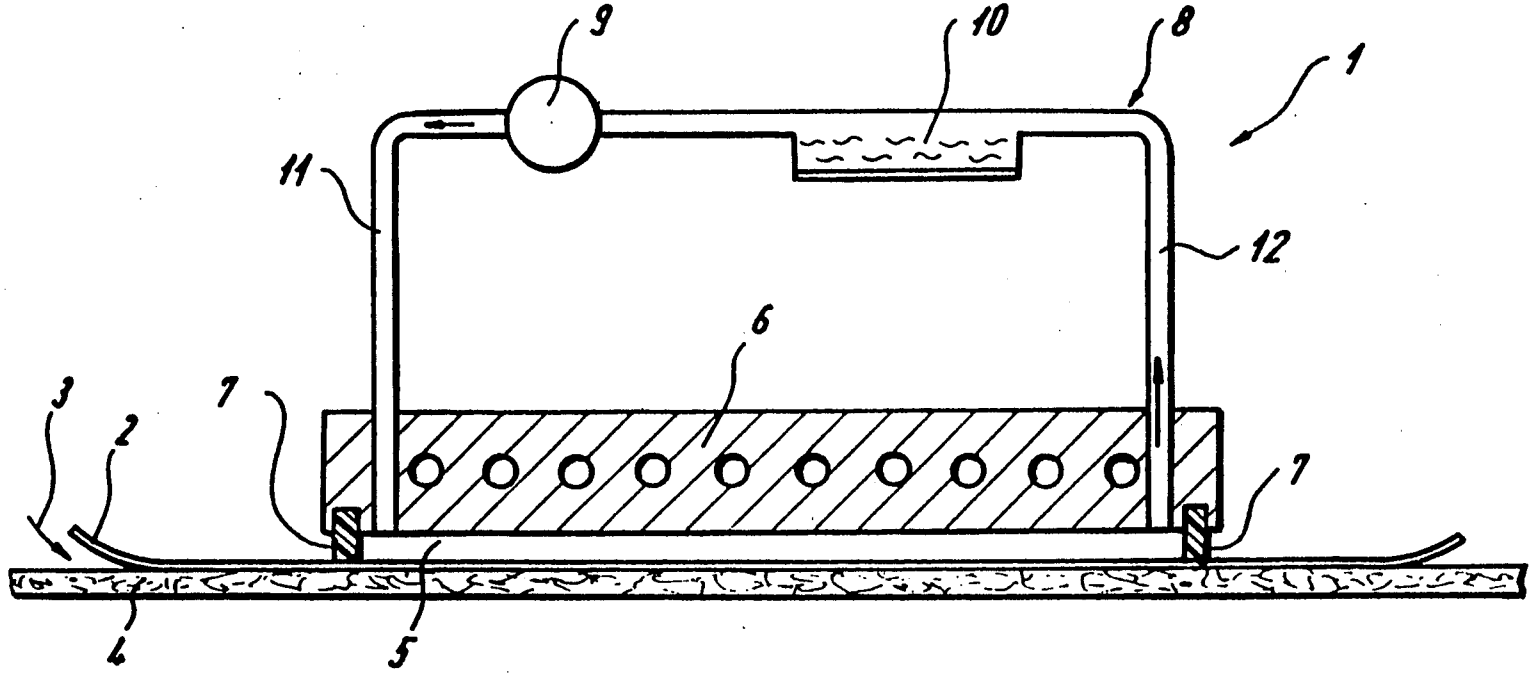
FIG. 1 is a sectional view of a press according to the invention.

FIG. 1 shows a continuously operating press 1, equipped with an endless pressure belt 2 preferably made of steel, said belt being guided over reversing rollers, not shown, and being driven by the reversing rollers. The pressure belt moves in the direction of arrow 3. By means of the press, workpieces 4, for example strips of material, are processed and moved continuously along a pressure chamber 5 by means of the driven pressure belt 2, said chamber being delimited by the back of the working run of the pressure belt, by a pressure plate 6, and by sealing strips 7 abutting the working run, with these sealing strips being fixed in a groove in pressure plate 6. Pressure plate 6 is heated and has heating means integrated in the pressure plate.

The pressure in pressure chamber 5 is generated by a pressure medium which is moved turbulently in the pressure chamber and guided through a circuit. A U-shaped channel 8 is provided for this purpose, said channel running partially outside pressure plate 6 in the embodiment shown. Channel 8 has a feed device 9 for circulating the pressure medium, said device being a fan for example. An evaporator 10 is also provided in the channel and is located on the suction side of the fan in the embodiment shown. Air is used as the pressure medium, and steam is added to it by evaporator 10.

In the embodiment shown in FIG. 1, pressure chamber 5 is made slot-shaped in the vicinity of the active zone between the underside of pressure plate 6 and the opposite back of the pressure belt.

In the embodiment shown, the gap width is the same over the entire length of the pressure chamber.

It is also possible, however, to design the pressure chamber so that it has several zones with different gap widths in the direction in which the pressure belt runs.

The steam-air mixture is fed into pressure chamber 5 through channel section 11 which runs vertically, and then flows out of pressure chamber 5 through channel section 12.

Figure 2:
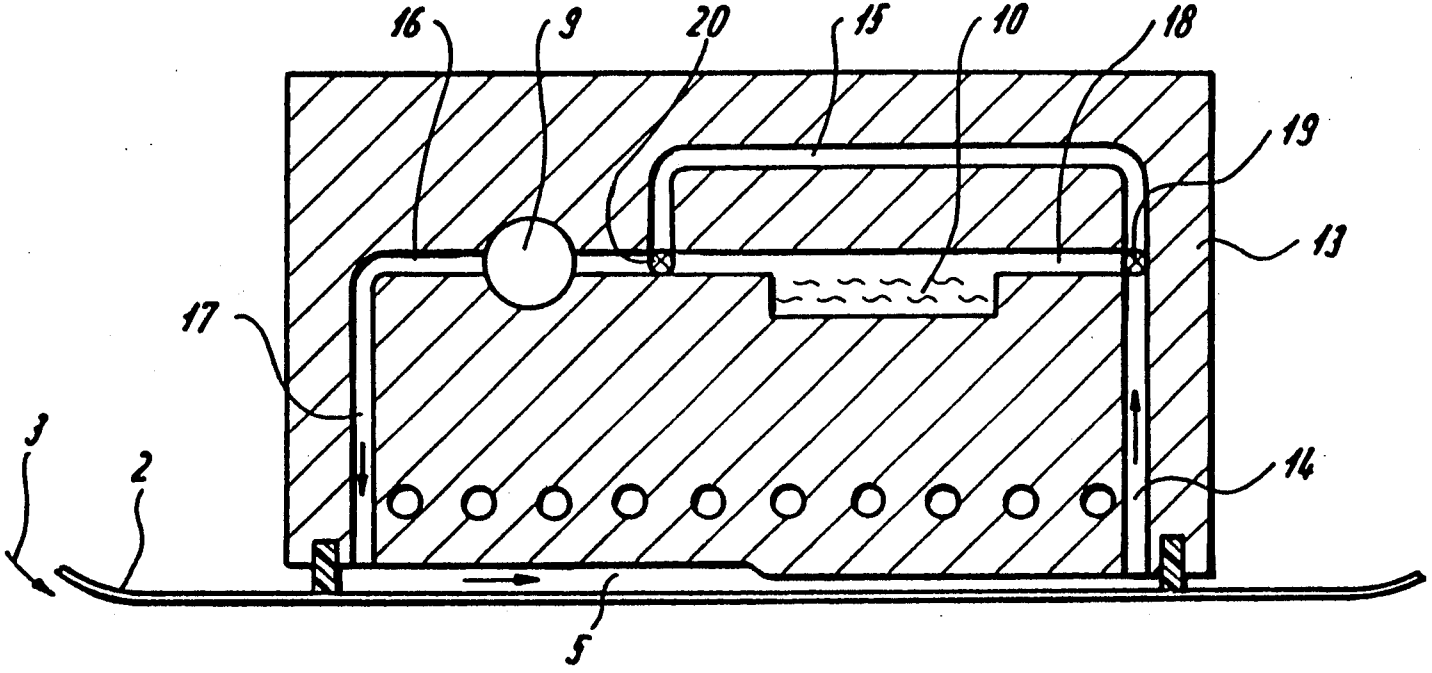
FIG. 2 is a sectional view of another embodiment according to the invention.

The pressure chamber can have at least two zones with different gap widths in the direction in which the pressure belt runs (as shown in FIG. 2). The zone of the pressure chamber which is adjacent to the inlet for the steam-air mixture could have a gap width less than that in the outlet area. In this manner, an increased flow rate would be produced in the inlet area, and hence a more intensive heat transfer from the heated pressure plate to the pressure belt. In this area, the quantity of heat given up to the pressure belt and hence to the workpiece is suddenly increased by the steam condensing on the back of the pressure belt.

It is also possible, however, to make the gap width in the inlet area for the pressure medium greater than in the outlet area.

In FIG. 2, an embodiment is shown in which feed device 9 for the pressure medium and evaporator 10 are integrated into pressure plate 13.

In this design, duct sections 14, 15, 16, and 17 form a circular duct for the pressure medium, with which a bypass line 18 is connected in which evaporator 10 is provided.

Fittings 19 and 20 are used to adjust the quantity of pressure medium fed through evaporator 10 and hence the proportions of the liquid vapor/steam.

Figure 3:
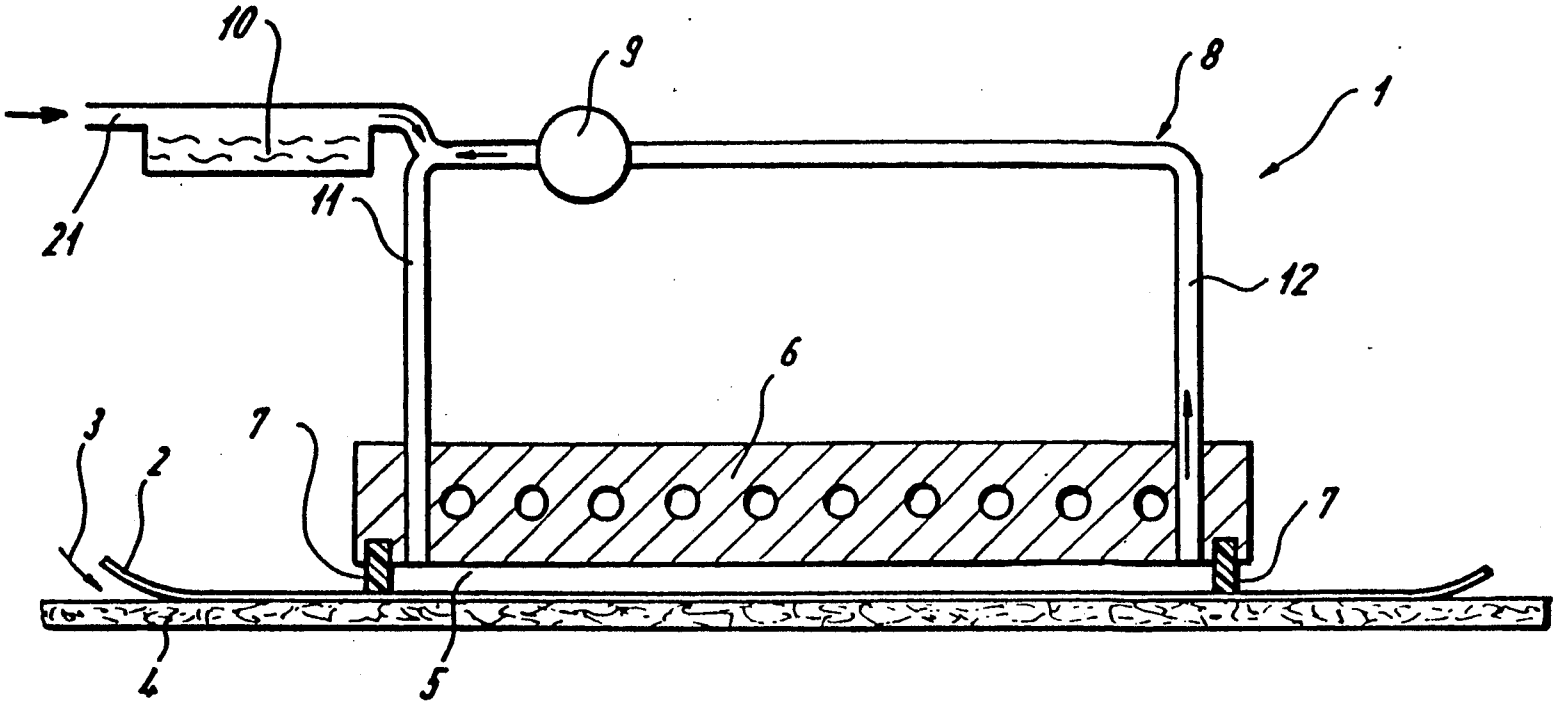
FIG. 3 is a sectional view of a further embodiment according to the invention.

In the embodiment shown in FIG. 3, in contrast to the embodiment shown in FIG. 1, evaporator 10 is disposed in a feed line 21 for the gaseous pressure medium.

The circular ducts in FIGS. 1 and 2 are likewise provided with a feed line for the gaseous pressure medium, but it is not shown in these figures. This feed line can also be used to compensate for leaks that develop in the pressure medium circuit.

What is claimed is:

1. In a method of heating a driven pressure-application belt of a continuous-operation press, wherein a chamber full of gas exerts pressure on an operating run of the belt, a gaseous pressure-generating medium circulates turbulently through the chamber formed between an inwardly heated pressure-application plate and a rear surface of the belt, and the belt conveys work along the chamber from an intake end of the chamber to an outlet end of the chamber, the improvement comprising: mixing steam with the gaseous medium prior to entry into the chamber, subjecting the rear surface of the belt to the mixture of steam and gaseous medium, condensing the steam to form droplets in the chamber to release the heat of evaporation thereof, whirling the droplets around by the turbulent circulation of the gaseous medium, re-evaporating the drops before the medium exits the chamber due to existing heat and absorbing the evaporate by the pressure medium.

2. The method according to claim 1, further comprising condensing the steam at least partially on the rear surface of the pressure belt in a zone adjacent to the intake.

3. The method according to claim 1, wherein the gaseous medium is an air stream saturated with steam before it enters the pressure chamber.

4. A device for heating a pressure belt of a press, comprising: a movable pressure belt, means including a pressure plate for forming a pressure chamber on a run of the belt including means forming an inlet to the chamber for a gaseous pressure medium and means forming an outlet from the chamber for the gaseous medium and means connected to the inlet and outlet for circulating the gaseous medium and for adding steam thereto comprising a channel located at least partially inside the pressure plate, a feed device in the channel for effecting circulation and an evaporator in communication with the channel.

5. The device according to claim 4, wherein the pressure chamber has at least one operative zone in the form of a gap.

6. The device according to claim 5, wherein the pressure chamber has at least two zones with different gap widths in a direction in which the pressure belt moves.

7. The device according to claim 6, wherein the gap width is less at the inlet than at the outlet.

8. The device according to claim 6, wherein the gap width is greater at the inlet than at the outlet.

9. The device according to claim 4, wherein the evaporator is disposed in a bypass line and further comprising means for varying the quantity of pressure medium conducted through the evaporator.

10. The device according to claim 4, wherein the feed device for the pressure medium comprises a fan having a suction side connected to the evaporator.

* * * * *